United States Patent [19]

Anlauf et al.

[11] 4,195,598

[45] Apr. 1, 1980

[54] METHOD AND APPARATUS FOR DETERMINING THE INJECTION TIME IN EXTERNALLY IGNITED INTERNAL COMBUSTION ENGINES

[75] Inventors: Jürgen Anlauf, Göppingen; Hans Schnürle, Walheim, both of Fed. Rep. of Germany

[73] Assignee: Robert Bosch GmbH, Stuttgart, Fed. Rep. of Germany

[21] Appl. No.: 930,110

[22] Filed: Aug. 1, 1978

[30] Foreign Application Priority Data

Aug. 6, 1977 [DE] Fed. Rep. of Germany ..... 2735601

[51] Int. Cl.[2] ..... F02B 3/00

[52] U.S. Cl. ..... 123/32 EA; 123/32 ED; 123/32 EB

[58] Field of Search ..... 123/32 EA, 32 ED, 32 EB, 123/117 R, 117 D, 148 E

[56] References Cited

U.S. PATENT DOCUMENTS

| | | | |
|---|---|---|---|
| 3,483,364 | 12/1969 | Leeson, Jr. | 123/32 EB |
| 3,724,430 | 4/1973 | Adler | 123/32 EA |
| 3,750,632 | 8/1973 | Zechnall | 123/32 EA |
| 3,796,197 | 3/1974 | Locher et al. | 123/32 EA |
| 4,034,722 | 7/1977 | Miyakawa | 123/32 ED |
| 4,048,964 | 9/1977 | Kissel | 123/139 E X |

FOREIGN PATENT DOCUMENTS 2426976 5/1976 Fed. Rep. of Germany ..... 123/32 EB

*Primary Examiner*—Ronald H. Lazarus
*Assistant Examiner*—P. S. Lall
*Attorney, Agent, or Firm*—Edwin E. Greigg

[57] ABSTRACT

A method and an apparatus for the determination of the injection time in externally ignited internal combustion engines, which serve to provide the optimal injection time under given operating conditions, this injection time being derived on the basis of the rpm and the angle of the throttle valve wherein a basic injection time signal is derived from an rpm and a throttle valve angle signal and this signal is subsequently modified by means of a controlled nonlinear function generator to closely approximate an empirically ascertained optimal value for the injection time under given operating conditions, the basic injection time signal being formed in a divider circuit to provide an output signal which is fed to at least one nonlinearity function generator controllable in accordance with the throttle valve angle and the rpm.

10 Claims, 4 Drawing Figures

OPTIMAL INJECTION TIME
ti/ms
1
2
3
4
5
6
THROTTLE VALVE ANGLE
70°
40°
30°
25°
20°
17,5°
15°
12,5°
10°
7,5°
5°
3°
10
20
30
40
50
60
RECIPROCAL RPM
T/ms

METHOD AND APPARATUS FOR DETERMINING THE INJECTION TIME IN EXTERNALLY IGNITED INTERNAL COMBUSTION ENGINES

BACKGROUND OF THE INVENTION

This invention relates to internal combustion engines and, more particularly, to the determination of injection time for such engines.

If the optimal injection time in internal combustion engines is related to the reciprocal of the rpm, where the throttle valve angle is the parameter, then approximate exponential functions (e-functions) are produced up to a throttle valve angle of about 30°. These functions become flatter with a decreasing throttle valve angle. At angles above about 30°, higher curves are produced, which flatten out in the approximate range of under two thousand revolutions per minute.

These characteristic curves are specific for each individual type of internal combustion engine, and are virtually the same within each series.

An apparatus is known for determining the injection time in internal combustion engines by means of the reproduction of characteristic curves, where the empirically derived and e-function-like characteristic curves are produced through resistor-condenser-charging circuits and in which the RC time constant is controlled through a throttle valve potentiometer. Since in this case, the potentiometer is operated as a controllable resistor, the absolute value of the electrical resistance must be kept within narrow tolerance limits in the entire control range. Since the time constant is hyperbolically dependent for its first approximation on the throttle valve angle, the maintenance of such narrow tolerances cannot be accomplished at a reasonable cost.

In another known circuit the potentiometer is replaced with a controlled resistor, whose absolute value is determined by the divider ratio of the transducer potentiometer.

All the known circuits for the reproduction of characteristic curves have proved to be problematical and inconvenient, especially since the reproduction of the curves requires great constancy and precision of timing and even more when the higher curve for the injection time has to be obtained at high rpm and at a large throttle angle.

OBJECTS, SUMMARY AND ADVANTAGES OF THE INVENTION

It is a principal object of the invention to reproduce the measured characteristic curves electrically in a simple manner and in this way to determine an optimal injection time derived from the easily ascertained operating characteristics of rpm and throttle valve angle.

It is possible, with the subject of the invention, to reproduce the empirically derived optimal injection times alomst exactly. In particular, the higher curve at high rpm may be reproduced with close approximation and further the injection times may be narrowed down over the entire throttle valve angle range at low rpm. Since the reproduction of the e-functions takes place in such a way by means of controlled nonlinearities, it is not the time constant of the nonlinearities as such which is varied but rather their charging time, so that no variation of the electrical values of the passive structural elements is required. This means also that no precise resistance or capacitance values need be adjusted or varied. Not the least in importance is that the entire circuit arrangement thus becomes cost-effective in its design and yet still furnishes an injection time in very close approximation to the optimal value. It has proven to be of advantage to combine the basic circuit according to the invention with an anti-bounce circuit. By means of the anti-bounce circuit, time intervals which may arise, for example in the drive of the rpm transducer, can be averaged out.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
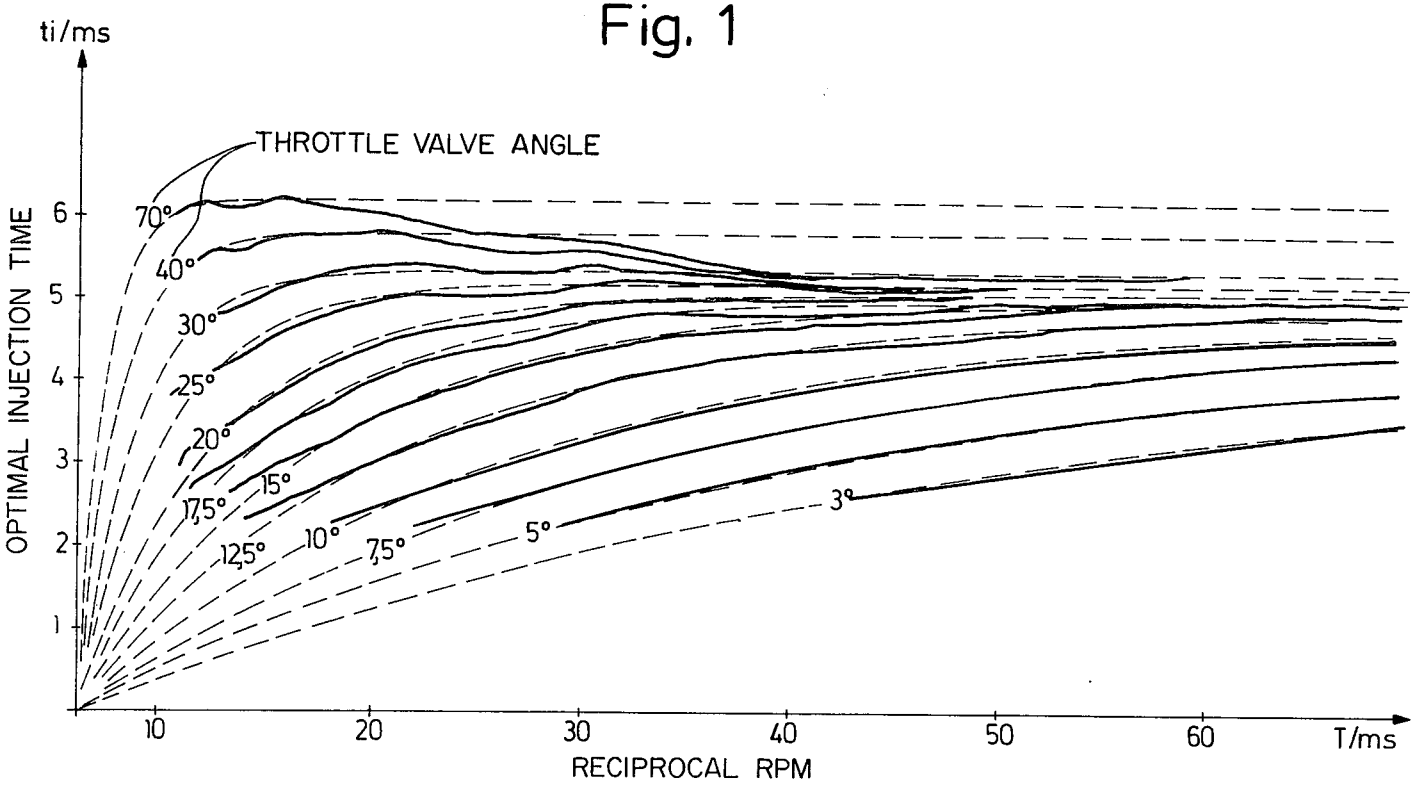
FIG. 1 is an empirically derived diagram in which the optimal injection time with respect to the reciprocal rpm and with the throttle valve angle as a parameter is plotted.

FIG. 1 shows the empirically derived optimal injection time for a particular internal combustion engine. Two features are important: first, the range of the injection time narrows over the entire throttle valve angle at low rpm or over a long period, and second, a higher curve for the injection time is produced at high rpm and at a large throttle valve angle. It can further be seen that the curves have the nature of e-functions, at least in the initial range of each one. Because of these patterns it is reasonable to reproduce the curves by means of controlled nonlinearities, whereby the throttle valve angle is the parameter.

Figure 2:
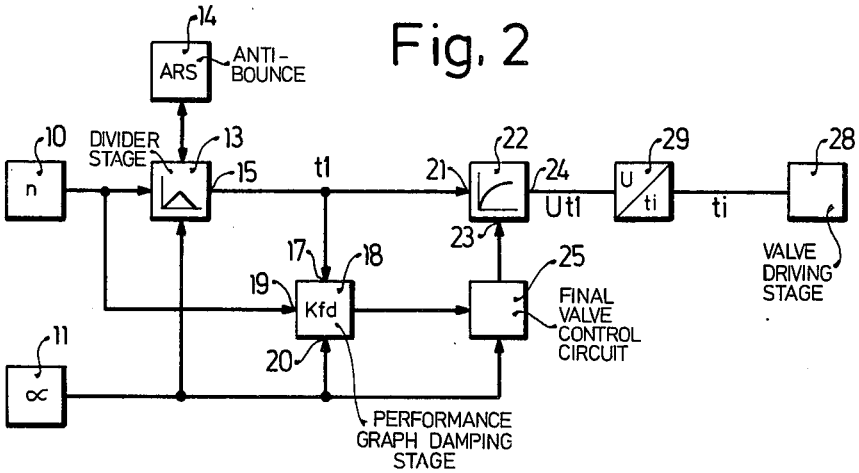
FIG. 2 is a schematic block diagram of the circuit arrangement of the invention.

FIG. 2 shows a schematic block circuit diagram of a circuit arrangement with which the empirically derived curves of FIG. 1 can be reproduced. The circuit of FIG. 2 includes an rpm transducer 10 and a throttle valve transducer 11. Both transducers 10 and 11 are connected to a divider stage 13 to which an anti-bounce circuit 14 is connected. A basic injection time signal appears at the output 15 of the divider stage 13 which signal has a length t1. The output 15 of the divider stage 13 is connected to an input 17 of a performance graph damping stage 18, which has two additional inputs 19 and 20. The divider stage output 15 is also connected to a first input 21 of a controllable nonlinearity function generator 22. The output of the performance graph damping stage 18 is connected to a final value control circuit 25, which is connected to a second input 23 of the controllable nonlinearity function generator 22. A correcting stage (not shown) is preferably connected to the output 24 of the controllable nonlinearity function generator in order to correct the injection time in accordance with further static correction values such as starting temperature, barometric pressure and others.

Both the performance graph damping stage 18 and the final value control stage 25 are directly connected with the throttle valve angle transducer 11 and are connected in part directly, in part indirectly, with the rpm transducer 10. Finally a voltage-time converter 29 is connected in front of the driving stages for the injection valves 28.

Figure 3:
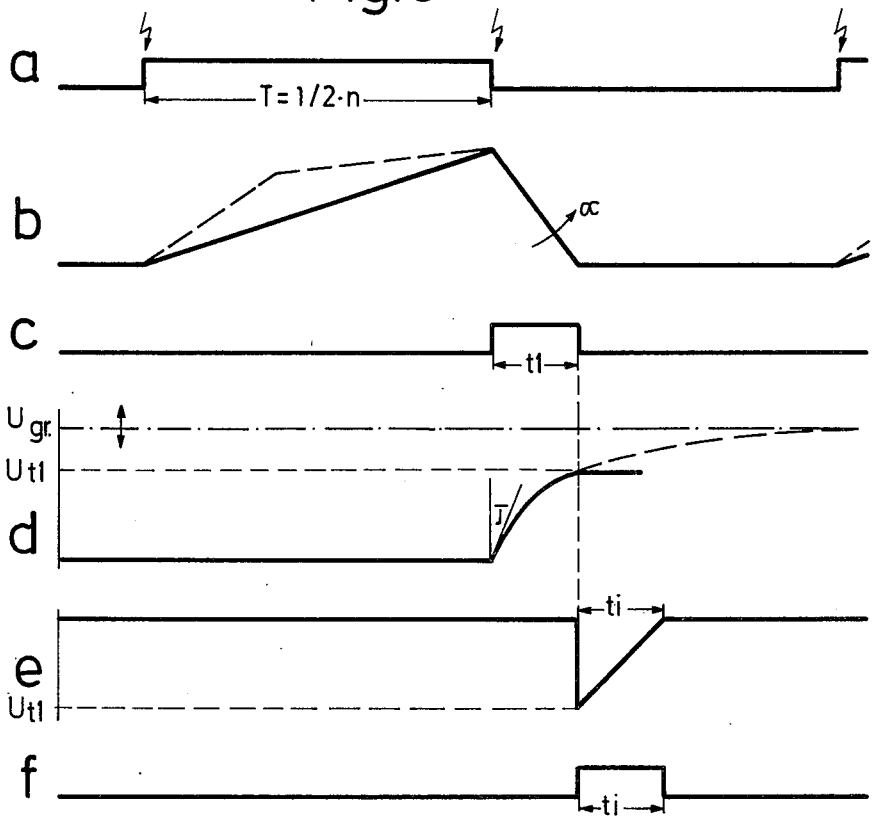
FIG. 3 is an impulse diagram pertaining to the circuit arrangement of FIG. 2.

The mode of operation of the circuit arrangement of FIG. 2 may be best described with the aid of the impulse diagrams of FIG. 3.

FIG. 3*a* shows the output signal of the rpm indicator 10, and it can be seen that the potential changes at each ignition impulse and thus produces an impulse duration T of $\frac{1}{2}\cdot n$. The division process in the divider stage 13 is shown in FIG. 3*b*. Here a memory contained in the divider stage 13 is linearly charged during the impulse duration of the rpm transducer signal and is discharged again at the end of the impulse duration in accordance with the throttle valve angle. FIG. 3*c* shows a signal havng the impulse duration t1, which corresponds in its length to the discharging time of the memory in the divider stage 13. Since the charging of the memory is directly proportional to the duration T equal to $\frac{1}{2}\cdot n$ and the discharging takes place in accordance with the throttle valve angle, a division signal is produced with the length of t1. The signal according to FIG. 3*c* is fed to the controllable nonlinearity function generator 22 and provides for a charging process according to an e-function over the duration t1 as shown in FIG. 3*d*. It is important with this nonlinearity that it is not the time constant which is controlled, that is, the initial increase of the charge voltage, but rather the instant up to which the charging process of a memory according to an e-function takes place. The charge voltage of the memory is transformed at the end of the charging time t1 in a voltage-time converter into the injection time ti which, in some cases, still remains to be corrected. The output signal ti of the voltage-time converter 29 is shown in FIG. 3*f*. If the injection time ti is represented graphically as a function of the duration T with the throttle valve angle as parameter, then e-functions are again the result, with time constants which decrease with an increasing throttle valve angle. These e-functions approximate the rpm-throttle-valve characteristic curves of internal combustion engines as in FIG. 1. They are not identical with the charging curve, which is likewise exponential, of the memory of the nonlinearity function generator. Thus, in this manner, e-functions may be generated via the charging duration t1 by varying the duration and the throttle valve angle, which e-functions have the same limiting value but differing time constants, although the time constant of the controllable nonlinearity function generator is not varied.

If the individual rpm-throttle valve characteristic curves in FIG. 1 are to be approximated by e-functions, in which only the time constant is varied, then a high ratio of the largest to the smallest time constant is produced. The range of variation is significantly limited if not only the time constant but also the limiting value is varied, towards which the injection time ti inclines over an infinitely long duration T. This is accomplished by controlling the limiting value, towards which the charging voltage of the controllable nonlinearity function generator inclines. The differing limiting value voltages are produced in the final value control stage 25, corresponding to the diagram in FIG. 1 in which these limiting value voltages increase with an increasing throttle valve angle.

The performance graph damping stage 18 serves to shorten the injection duration ti at lower rpm and at a large throttle valve angle; to this end, the damping stage 18 receives information from the rpm transducer 10 and the throttle valve angle transducer 11.

In FIG. 3*b*, the mode of operation of the anti-bounce circuit 14, which cooperates with the divider stage 13, is shown in broken lines. According to this representation, the charging process of the memory in the divider stage 13 takes place in two sections having a differing slope, whereby the second charging section proceeds with a significantly more limited slope of the signal voltage. These anti-bounce circuits are sufficiently well known from the literature; they are able to damp intervals in the output signal of the rpm transducer 10 for the purpose of further processing of the signal.

Figure 4:
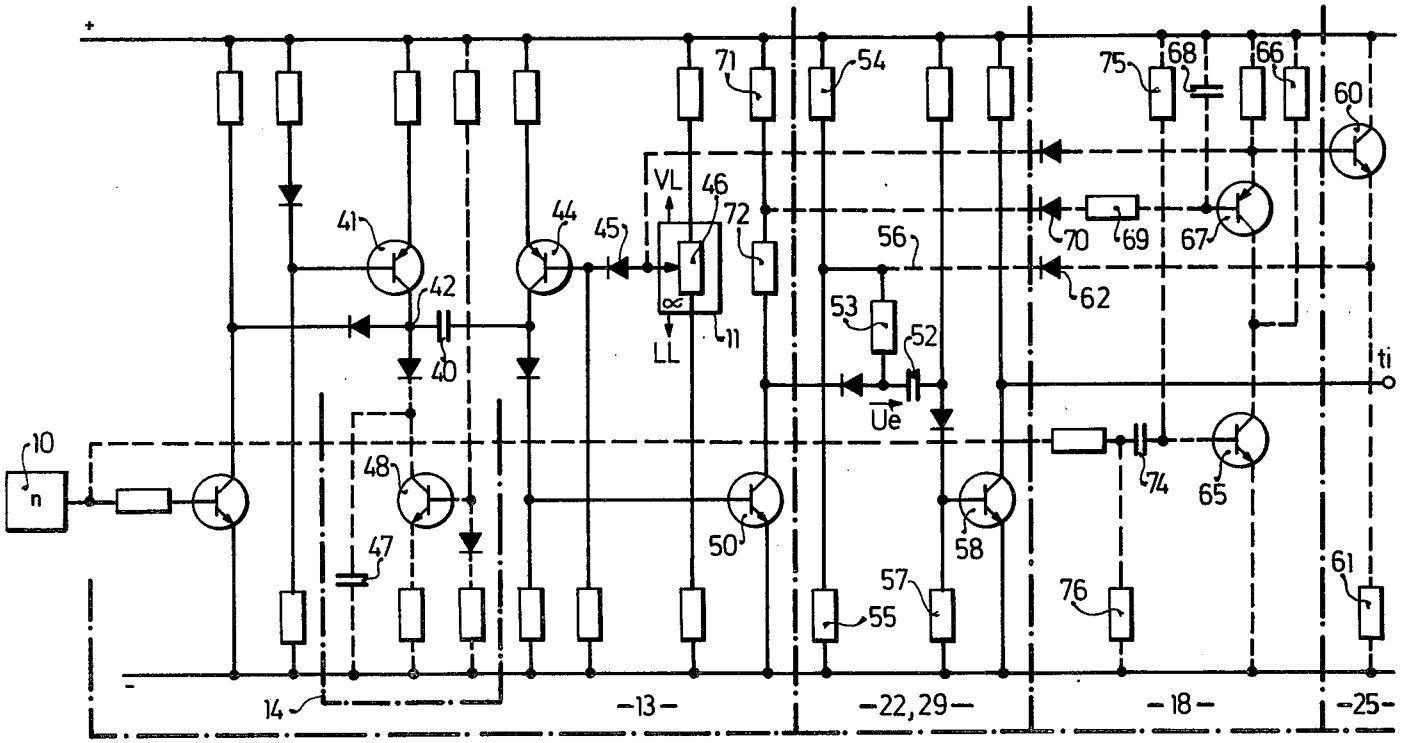
FIG. 4 is a schematic wiring diagram of a practical embodiment of the most important parts of the circuit arrangement of the block diagram of FIG. 2.

FIG. 4 shows a detailed wiring diagram for the circuit arrangement of FIG. 2. For the sake of clarity, there are perpendicular, heavy dot-and-dash lines as well as broken lines showing the individual components of divider stage 13, anti-bounce circuit 14, controllable nonlinearity function generator 22, performance graph damping stage 18, final value control stage 25, and the voltage-time converter 29. As transducers for the operating conditions rpm and throttle valve angle, the rpm transducer 10 and the throttle valve angle transducer 11 are shown. The design and functional sequence of the individual parts is described as follows. The capacitor 40 comprises the memory in the divider stage 13. It is fed from a constant current source through a transistor 41, whenever the potential at the connection point 42 of capacitor 40 and transistor 41 has not been lowered by an input impulse. The discharging of the memory 40 in accordance with the throttle valve angle is accomplished by the current source, controlled in accordance with the throttle valve angle, with a transistor 44, the base of which is connected through a diode 45 with a potentiometer 46 coupled to the throttle valve.

The anti-bounce circuit 14 is formed of a capacitor 47 and a constant current source with a transistor 48, whereby this capacitor 47 is connected parallel to the capacitor 40 which begins charging at a certain charge status, i.e., receiving a portion of its charging current.

If the potential at the connection point 42 between capacitor 40 and the charge current source through the transistor 41 is lowered as a result of a signal from the rpm transducer 10, then this potential is further transferred to the base of a transistor 50 connected in series. The signal of FIG. 3*c* appears at the collector of this transistor 50. The controllable nonlinearity function generator 22 contains a capacitor 52 as its memory, which is charged through a resistor 53 from a voltage divider formed by resistors 54 and 55, and the potential of the voltage divider can additionally be influenced at its dividing point via a line 56. Since the voltage on the line 56, which is at the same time connected with the middle dividing point of the voltage divider between the resistors 54 and 55, is supplied at a low resistance, the time constant of the capacitor charge is dependent only on the value of the resistor 53 and the capacitance of capacitor 52. The capacitor 52 can be charged as long as the potential at the collector of the transistor 50 is at a high level, that is, as long as the transistor 50 is blocked. If the potential at the collector of the transistor 50 changes abruptly after the time period t1 has run out, then the voltage drop is transferred to the base of a subsequent transistor 58 because of the fact that the voltage across a capacitor cannot change abruptly. This subsequent transistor 58 is blocked up to the moment when its base potential is elevated by a change in the charge of the capacitor 52 back to a predetermined level, and the output signal appears at the collector of this transistor 58 in the form of an injection time ti.

The final value control takes place with the final value control stage 25 provided with a transistor 60, whose base is directly connected with the contact arm of the potentiometer 46, which is connected with the throttle valve. At full load (VL) as opposed to idling (LL), there is a high potential at the dividing point of the voltage divider, which results in a high flow of current through the transistor 60 and raises the potential at the emitter of transistor 60, which is connected through a resistor 61 to a ground line. Since the emitter of transistor 60 is coupled through a diode 62 to the connecting line 56, which determines the limiting value voltage for the capacitor 52 of the controllable nonlinearity function generator 22, the potential at the emitter of transistor 60 rises with an increase in the throttle valve angle; thus the limiting value for the voltage across the capacitor 52 also rises through the diode 62. Since as a result of the approximately linear voltage-time-conversion of an increased capacitor voltage, an increased injection time can also be associated with it, the injection curve plotted in FIG. 1 results at high rpm and at various throttle valve angles.

The performance graph damping stage 18 serves to damp the injection time at large throttle valve angles and lower rpm. This stage contains primarily a switch with a transistor 65, the collector of which is connected on the one hand with a positive line through a resistor 66 and on the other with the emitter of a further transistor 67, the collector of which is coupled with the base of transistor 60. The base of transistor 67 is connected through capacitor 68 to the positive line on the one hand and on the other hand through a resistor 69 and a diode 70 to the dividing point of a voltage divider formed by resistors 71 and 72 connected in series with the transistor 50.

According to the diagram of FIG. 1 the injection time ti should drop with decreasing rpm and increasing throttle valve angle. To accomplish this an information signal from the rpm transducer 10 and one from the throttle valve angle transducer 11 must therefore be processed. The rpm transducer information is fed from the rpm transducer 10 across a capacitor 74 to the base of transistor 65. This capacitor 74 together with two resistors 75 and 76, each leading from one terminal of capacitor 74 to one of the lines of the voltage source, respectively acts as a timing element. A negative drop in potential at the rpm transducer 10 is transferred across the capacitor 74 to the base of transistor 65 and blocks that transistor until the potential on the base side is again elevated through the resistor 75. During the blocked state of transistor 65, its collector is in contact with high potential and the capacitor 68 discharges across the base-collector-diode of transistor 67 and across the resistor 66. If the transistor 65 switches into conduction, then the capacitor 68, with a time constant determined by the values of the resistor 69 and the capacitor 68, charges to a voltage level which is determined by the divider ratio of the resistors 71 and 72 at the conducting transistor 50. This charging process in turn, along with the position of the potentiometer 46 connected with the throttle valve, determines the emitter potential of transistor 67 and thus, through transistor 60, the maximal charge voltage of the capacitor 52. The influence of the emitter potential of transistor 67 can now be selected according to the diagram in FIG. 1 showing the relationship of the individual values, in such a way that the potential drops on the connecting line 56 for decreasing rpm and at larger throttle angles.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A method of determining the injection time in externally ignited internal combustion engines including the steps of providing an rpm signal and a throttle valve angle signal, deriving a basic injection time signal on the basis of said rpm signal and said throttle valve angle signal, modifying said basic injection time signal by means of a controllable nonlinearity function generator containing an e-function to closely approximate an empirically derived optimal value for the injection time at given operating characteristics, maintaining the time constant of said function generator at a constant value and controlling the charging and/or discharging time of said function generator.

2. A method according to claim 1, including the step of controlling said nonlinearity function generator by means of a variable limiting-value voltage.

3. A method according to claim 2, wherein said limiting-value voltage of the e-function is increased at a constant rpm with an increase in the throttle valve angle.

4. A method according to claim 2, wherein the limiting-value of the e-function is lowered with a decrease in rpm and with an increase in the throttle valve angle.

5. An apparatus for determining the injection time in externally ignited internal combustion engines comprising, in combination, means for producing an rpm signal, means for producing a throttle valve angle signal, means for deriving a basic injection time signal, a divider stage coupled to said rpm signal producing means and to said throttle valve angle signal producing means for deriving said rpm and said throttle valve angle signals and a controllable nonlinearity function generator having a predetermined, non-variable constant coupled to the outlet of said divider stage and means for modifying said basic injection time with said controllable nonlinearity function generator to closely approximate an empirically derived optimal value for the injection time at given operating characteristics.

6. An apparatus according to claim 5, including a voltage-time-converter coupled to the outlet of said controllable nonlinearity function generator.

7. An apparatus according to claim 5, including a final-value control stage coupled to said controllable nonlinearity function generator for controlling the limitingvalue voltage of the nonlinearity function generator.

8. An apparatus according to claim 7, including a performance graph damping stage connected at least to said final-value control stage.

9. An apparatus according to claim 8, including means for feeding said rpm and/or throttle valve angle signals to said performance graph damping stage and/or to said final-value control stage.

10. An apparatus according to claim 5 including an anti-bounce circuit coupled to said divider stage.

* * * * *